United States Patent [19]

Titus

[11] 4,441,715

[45] Apr. 10, 1984

[54] SPHERICAL PUZZLE

[76] Inventor: Stephen C. Titus, 1210 Arlington Blvd., Ann Arbor, Mich. 48104

[21] Appl. No.: 365,502

[22] Filed: Apr. 5, 1982

[51] Int. Cl.[3] ..... A63F 9/08

[52] U.S. Cl. ..... 273/153 S

[58] Field of Search ..... 273/153 S; 46/25, 26, 46/30, 31; 434/131, 132

[56] References Cited

U.S. PATENT DOCUMENTS

| | | | |
|---|---|---|---|
| 888,854 | 5/1908 | Sheldon | 434/132 |
| 3,951,294 | 4/1976 | Wilson | 46/30 |
| 4,345,762 | 8/1982 | Lebelson | 273/160 X |
| 4,377,286 | 3/1983 | Constantinescu | 273/153 S |
| 4,378,117 | 3/1983 | Rubik | 273/153 S |

FOREIGN PATENT DOCUMENTS

| | | | |
|---|---|---|---|
| WO81/01638 | 6/1981 | PCT Int'l Appl. | 273/153 S |

*Primary Examiner*—Anton O. Oechsle

*Attorney, Agent, or Firm*—James M. Deimen

[57] ABSTRACT

The invention comprises a puzzle with the exterior shape of a sphere. The sphere comprises an even plurality of pieces formed by planes having in common a line joining two diametrically opposite poles of the sphere. The pieces are rotatably fastened together at the planes such that any two hemispheres, chosen by selecting one of the planes, can be rotated relative to each other. In the preferred embodiment the puzzle comprises six pieces formed by three planes 60° apart. The puzzle is hollow with slideable interlocking connections between the pieces such that any two hemispheres selected can be rotated 180° relative to each other. The sequential 180° rotation of differing pairs of hemispheres scrambles and unscrambles the puzzle. The solution to the puzzle is identified by an easily recognizeable pattern on the exterior of the sphere such as a globular map of the earth.

14 Claims, 14 Drawing Figures

SPHERICAL PUZZLE

BACKGROUND OF THE INVENTION

The invention pertains to the puzzle art, in particular, to three dimensional puzzles that are to be solved by unscrambling a plurality of interconnected pieces without disassembly to form a recognizeable pattern.

The puzzle art currently known by the applicant that comprises a plurality of interconnected pieces to be unscrambled by rotating some of the pieces relative to each other sequentially along planes in space, is exemplified by the popular Rubik's Cube, the Pyramid and the Snake, all readily available in toy stores. The rotation of individual pieces or groups of pieces provides a great number of possible combinations of the individual pieces only one or a few of which are solutions. The solutions are pattern or color combinations selected by the creator or manufacturer to be the solutions as distinguished from all the other possible combinations of the pieces.

The Rubik's Cube, the Pyramid and the Snake require a substantial number of individual pieces to create a puzzle of sufficient challenge to keep the interest of the user. The 3×3×3 Rubik's Cube for example has 26 exteriorly facing separate cubes. The Pyramid and the Snake have similar numbers of separate elements to create enough possible combinations to be an adequate challenge to all puzzle lovers.

More recently the 4×4×4 Rubik's Cube and the Rubik's Sphere have come on the market. This Rubik's Cube has 56 exteriorly facing separate cubes. The Rubik's sphere has a plurality of pieces formed by lateral and longitudinal planes whereby the pieces may be rotated as with the cubical puzzles.

SUMMARY OF THE INVENTION

The invention comprises a puzzle with the exterior shape of a sphere. The sphere comprises an even plurality of pieces formed by a plurality of planes having in common a line joining two diametrically opposite poles of the sphere. The pieces are rotatably fastened together at the planes such that any two hemispheres, chosen by selecting any one plane between the pieces, can be rotated relative to each other.

In the preferred embodiment disclosed below, the puzzle comprises six pieces formed by three planes 60° apart. The puzzle is hollow with slideably interlocking connections between the pieces such that any two hemispheres selected can be rotated 180° or more relative to each other. The sequential 180° rotation of differing pairs of hemispheres scrambles and unscrambles the puzzle.

The proper solution of the puzzle is identified by an easily recognizeable pattern on the exterior of the sphere such as a globular map of the earth. More challenging patterns are that of the moon or one of the other planets.

The interlocking connections between the pieces comprise modified T-shaped studs and slots that provide complete interlocked retention in all relative rotational positions of any two hemispheres except the "90°" relative position where a snap fit permits the pieces to be assembled and disassembled. Aside from the exterior pattern the pieces are not identical in their interlocking connections. Rather pieces either have T - slots on both longitudinal planes or have T - studs. The two types of pieces alternate in position as the sphere is circumnavigated about its "equator".

Applicant's spherical puzzle comprises a sufficient number of possible combinations to be a challenge to all puzzle lovers with substantially fewer pieces than that necessary for the prior art puzzles noted above.

Figure 5:
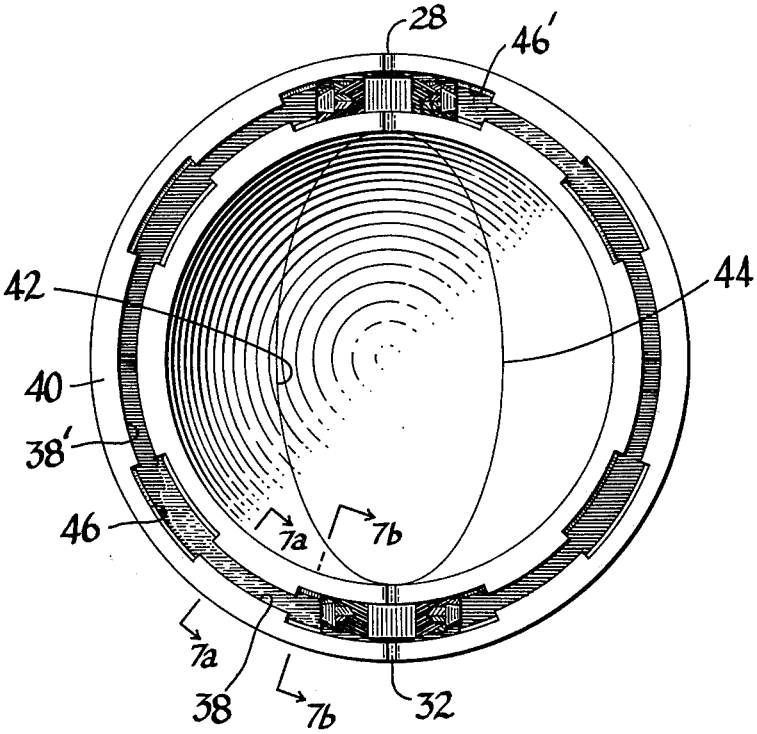
FIG. 5 illustrates the female slideable connecting means on a longitudinal plane between any two hemispheres.
Figure 6:
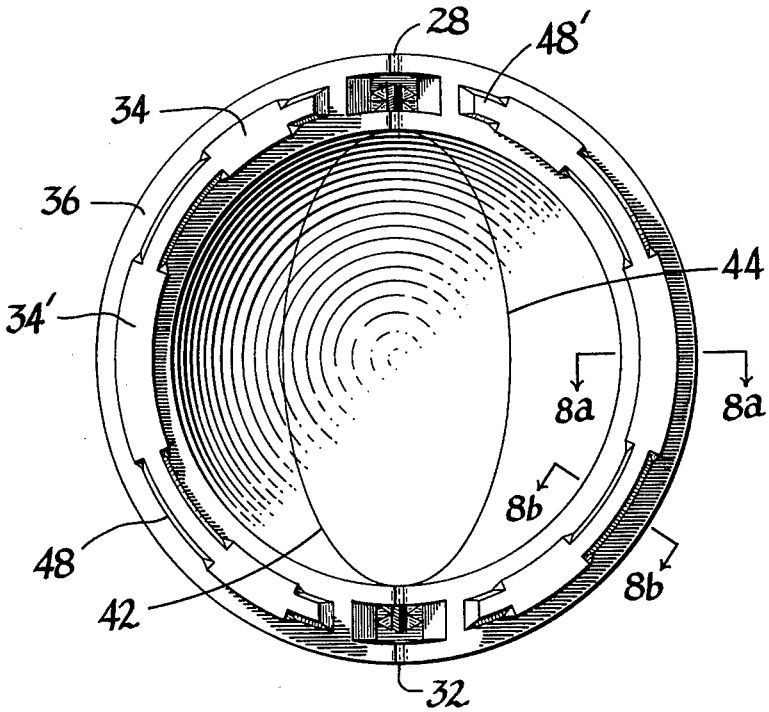
FIG. 6 illustrates the male slideable connecting means on a longitudinal plane between any two hemispheres.

FIGS. *7a* and *7b* are partial cross sections taken along the lines *7a—7a* and *7b—7b* respectively of FIG. 5;

FIGS. *8a* and *8b* are partial cross sections taken along the lines *8a—8a* and *8b—8b* respectively of FIG. 6;

FIGS. *9a* and *9b* illustrate the sections of FIGS. 7 and 8 when any two hemispheres are sildeably latched together; and, FIGS *10a* and *10b* illustrate the sections of FIGS. 7 and 8 when any two hemispheres are rotated to permit snap fit assembly or disassembly.

DESCRIPTION OF THE PREFERRED EMBODIMENT

Figure 1:
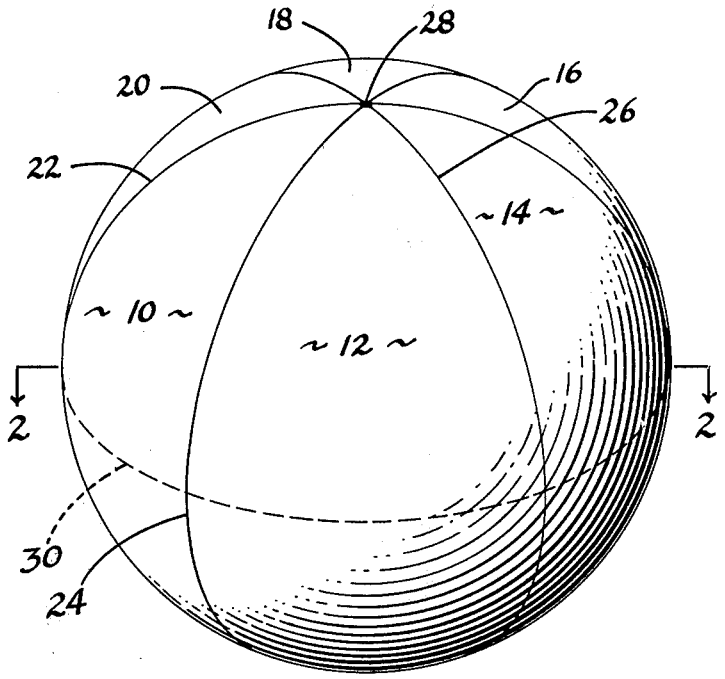
FIG. 1 is a perspective view of the spherical puzzle.

FIG. 1 illustrates the spherical puzzle without exterior embellishment or pattern. The sphere is divided into six spherical slices or sections 10, 12, 14, 16, 18 and 20 by three planes 22, 24 and 26 through a "north pole" 28 and diametrically opposite "south pole" (not shown in FIG. 1). The circumferential "equator" equidistant from the poles is indicated by the dotted line 30. The spherical sections 10 through 20 appear identical on the unadorned assembled sphere, however, the sections are internally unalike as described below.

Figure 2:
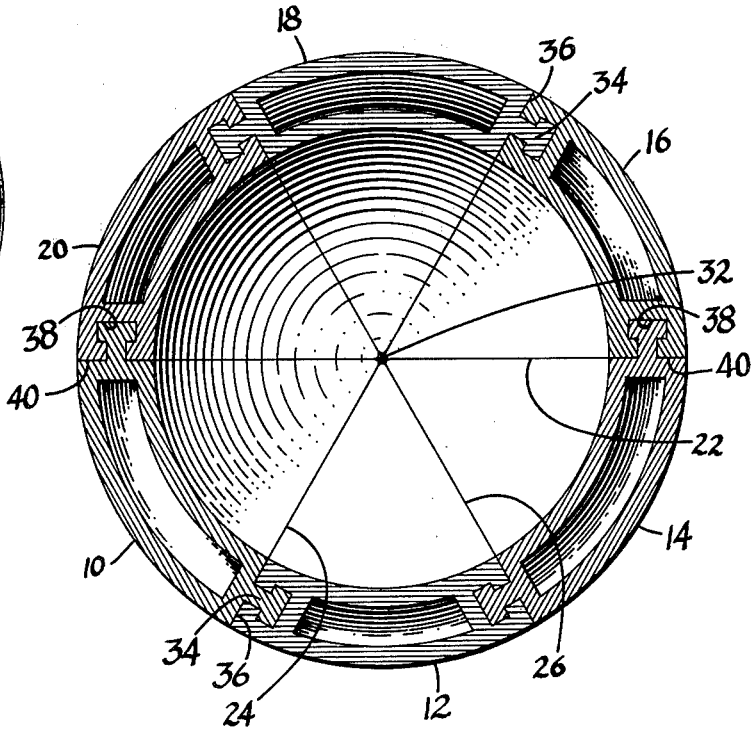
FIG. 2 is a cross section of the puzzle taken through the equatorial plane 2—2 of FIG. 1.

In FIG. 2 an equatorial hemisphere taken from the sphere of FIG. 1 is shown, each of the sections being cut at the equator 30. The sections 10 through 20 are seen to be of two types alternatingly arranged about the south pole 32. Sections 10, 14 and 18 include male T - shaped studs 34 extending from the edges 36 of these sections, the edges 36 being coincident with the longitudinal planes 22, 24 and 26. Sections 12, 16 and 20 are formed with complementary T - shaped female grooves 38 extending from the edges 40 of these sections, the edges 40 also being coincident with the longitudinal planes 22, 24 and 26.

Figure 3:
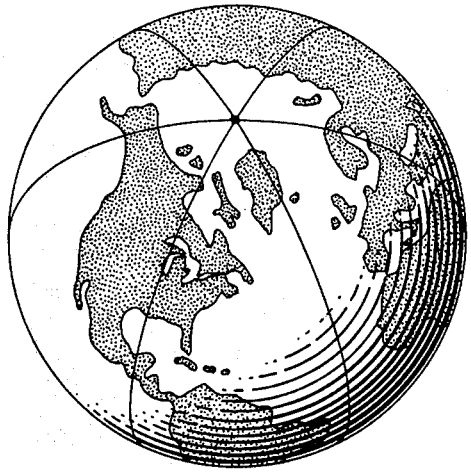
FIG. 3 is a perspective view of the puzzle patterned with the "earth"
Figure 4:
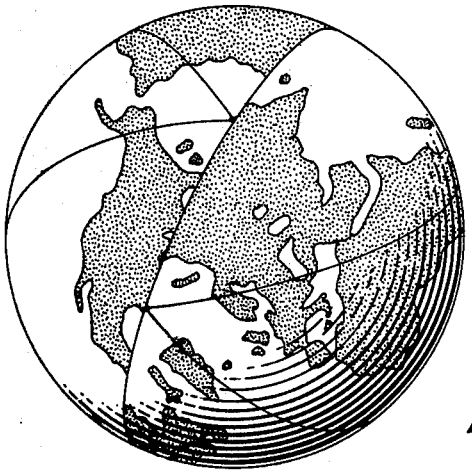
FIG. 4 is a view of FIG. 3 illustrating the movement of one hemisphere relative to another hemisphere.

The T - shaped connections between the sections are formed with a sliding fit such that any two hemispheres formed by one of the longitudinal planes 22, 24 or 26 may be rotated relative to each other as best shown by comparing FIGS. 3 and 4. In FIGS. 3 and 4 the exterior of the sphere is embellished with a globular map of the earth. The pattern of the earth creates a unique solution to the puzzle. By sequentially rotating pairs of hemispheres 180° out of phase, the sections 10 through 20 can be jumbled into any one of 384 different combinations, only one of which is the solution.

By dividing the sphere with additional longitudinal planes, the number of sections can be increased and the number of possible combinations greatly increased. The number of possible longitudinal planes dividing the sphere can be given by the mathematical expression $2N+1$ with the number of sections given by the expression $4N+2$ where N is a positive integer. A sphere with 10 sections has 1,474,560 possible combinations; with 14 sections approximately $3\times10^{10}$; with 18 sections approximately $1.9\times10^{15}$; and with 22 sections approximately $3\times10^{20}$.

To add further challenge to the puzzle and additional learning experience, the globular map of the moon or one of the planets may be substituted for the earth. Arbitrary multicolored patterns of sections may also be selected to embellish the exterior of the sphere.

Referring to FIGS. 5 and 6 the appearance of any pair of hemispheres separated along one of the longitudinal planes 22, 24 or 26 is illustrated. In FIG. 5 the female T - shaped groove 38 is shown formed in the edge 40 and in FIG. 6 the male T - shaped stud 34 formed on edge 36 is shown. Lines 42 and 44 indicate the other two connections at the other two longitudinal planes.

Figure 7A:
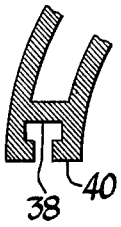
Figure 7B:
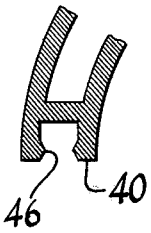
Figure 9A:
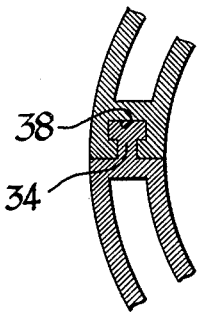
Figure 9B:
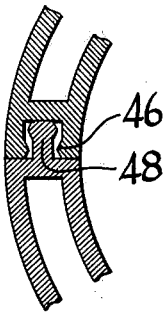
Figure 10A:
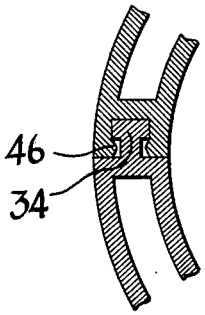
Figure 10B:
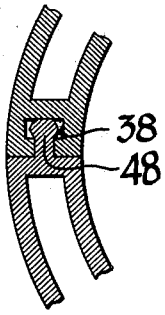
Figure 8A:
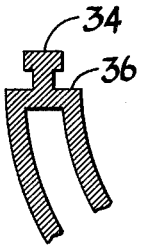
Figure 8B:
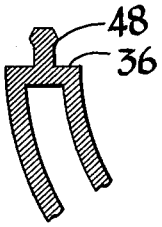

To facilitate assembly and disassembly of the sections, the T - shaped studs 34 and T - shaped grooves 38 are modified at selected locations to permit snap fit connection rather than full T - shaped sliding fit interlock. The full T - shaped groove and stud are illustrated in FIGS. 7*a* and 8*a*. The modified T - shaped groove and stud are illustrated in FIGS. 7*b* and 8*b*. As shown the grooves are beveled or relieved at 46 and the studs relieved at 48. With the hemispheres of FIGS. 5 and 6 assembled together and at the 0° and 180° positions (coincident hemispherical north and south poles or fully anticoincident north and south poles), the T - shaped studs 34 and grooves 38 are fully interlocked and the modified studs 48 and grooves 46 engaged as shown in FIGS. 9*a* and 9*b* respectively.

Rotation of one hemisphere 90° relative to the other brings the stud 34 into registry with the modified groove 46 and modified stud 48 into registry with the groove 38. In this relative position the hemispheres can be snap fitted apart or together. To assure that the assembly - disassembly position is limited to the 90° relative position, the T - shaped studs 34' and grooves 38' at the equator and the studs 48' and grooves 46' at the poles encompass larger circular arcs than the studs and grooves intermediate thereto. Thus, the hemispheres can only be separated at the 90° position and there is a positive interlock at all other relative rotational positions.

I claim:

1. A spherical puzzle comprising a plurality of sections formed by longitudinal planes intersecting along a common line between diametrically opposite poles on the sphere and intersecting the surface of the sphere with each of said sections extending from pole to pole, said plurality of sections divided into two equal sets of sections with members of each set alternating in position with members of the other set about the equator of said sphere and with the total number of sections comprising the sphere defined by $4N+2$ where N is a positive integer, and, means attaching said sections together to form said sphere, said attaching means on one set identical on both planes of each section of the one set and the attaching means on the other set identical on both planes of each section of the other set, said attaching means on the one set being complementary to the attaching means on the other set, said attaching means including means to permit relative hemispherical rotation between any two hemispherical groups of sections separated by a longitudinal plane.

2. The puzzle of claim 1 wherein the attachment means interlock to retain the sections assembled.

3. The puzzle of claim 1 wherein the attachment means comprises arcuate T - shaped slots on both planes of alternating sections and complementary arcuate T - shaped studs on both planes of sections between said sections with slots.

4. The puzzle of claim 3 wherein portions of said T - shaped slots and T - shaped studs are relieved to permit snap fit assembly and disassembly of said sections into a sphere.

5. The puzzle of claim 4 wherein the arcuate length of said relieved slots and studs at the poles of said sphere and the unrelieved arcuate length of said slots and studs at the equator are equal and greater than the relieved and unrelieved lengths of the slots and studs between the equator and each pole.

6. The puzzle of claim 1 including means whereby the equator of any one hemisphere is rotated to intersect the poles of the complementary hemisphere to assemble or disassemble the one hemisphere to or from the other complementary hemisphere.

7. The puzzle of claim 1 wherein the external appearance of the puzzle comprises a globular map of the earth.

8. The puzzle of claim 1 wherein the external surface of the puzzle comprises a globular map of one of the planets or planetary satellites of the solar system excepting the earth.

9. The puzzle of claim 1 wherein the external surface of the sphere comprises a relief map of the earth.

10. The puzzle of claim 1 wherein the external surface of the sphere comprises a relief map of one of the planets or planetary satellites of the solar system excepting the earth.

11. A spherical puzzle comprising a plurality of sections formed by longitudinal planes intersecting along a common line joining diametrically opposite poles on the sphere and intersecting the surface of the sphere with each of said sections extending from pole to pole, said plurality of sections divided into two equal sets of sections with members of each set alternating in position with members of the other set about the equator of said sphere and with the total number of sections comprising the sphere defined by $4N+2$ where N is a positive integer, arcuate T-shaped slots formed on both planar sides of alternatingly located sections, and, arcuate T-shaped studs formed on both planar sides of the sections located between the slotted sections, the T-shaped studs being sized and located for complementary engagement with said slots and the centers of curvature for said complementary slots and studs being the center of the sphere.

12. The puzzle of claim 11 wherein the complementary slots and stud are located adjacent the surface of the sphere.

13. The puzzle of claim 11 wherein arcuate portions of the slots and studs are relieved to permit snap fit assembly and disassembly of the sections that form the sphere.

14. The puzzle of claim 11 wherein the complementary slots and studs permit slidable rotational engagement between any two hemispheres formed by groups of sections on opposite sides of a longitudinal plane forming the sections.

* * * * *